United States Patent [19]

Krumholz et al.

[11] Patent Number: 4,930,277

[45] Date of Patent: Jun. 5, 1990

[54] PANEL ASSEMBLY AND SUPPORT STRUCTURE FOR ELEVATED FLOORS

[75] Inventors: Frank C. Krumholz; Michael D. Jines, both of Owatonna, Minn.

[73] Assignee: Wenger Corporation, Owatonna, Minn.

[21] Appl. No.: 454,177

[22] Filed: Dec. 21, 1989

Related U.S. Application Data

[62] Division of Ser. No. 394,283, Aug. 15, 1989, abandoned, which is a continuation of Ser. No. 276,086, now abandoned.

[51] Int. Cl.[5] ..... E04B 1/00

[52] U.S. Cl. ..... 52/263; 52/182

[58] Field of Search ..... 52/263, 8, 182

[56] References Cited

U.S. PATENT DOCUMENTS 3,099,336 7/1963 Hawkins ..... 52/182
3,425,173 2/1969 Carlo ..... 52/8 X
3,470,663 10/1969 Tak ..... 52/263 X
4,676,036 6/1987 Bessert ..... 52/263 X

FOREIGN PATENT DOCUMENTS 0059582 9/1982 European Pat. Off. ..... 52/8

*Primary Examiner*—Carl D. Friedman
*Attorney, Agent, or Firm*—Dorsey & Whitney

[57] ABSTRACT

An elevated floor has two separate types of floor panels arranged in alternating order on adjustable support legs. Base floor panels and access floor panels are formed from squares of low density oriented strand material having extruded metal cladding strips along the peripheral edges of the squares. The base floor panels include edge cladding strips having a support flange extending outwardly from the base panel peripheral edge. The access panels include a different type of cladding strip designed to seat on the support flange of the base panel cladding strip. Detachable riser beams are provided for assembly of multilevel stepped raised floors.

8 Claims, 9 Drawing Sheets

PANEL ASSEMBLY AND SUPPORT STRUCTURE FOR ELEVATED FLOORS

This is a division of application Ser. No. 394,283, filed Aug. 15, 1989, which is a continuation of Ser. No. 276,086, now abandoned.

TECHNICAL FIELD

This invention relates to elevated floors. More particularly, the invention relates to a floor panel design and support structure for an elevated floor that is especially designed for the rapid assembly, disassembly, and reconfiguration of the elevated floor.

BACKGROUND ART

Elevated floors are commonplace in computer rooms, office environments, electronic "clean" rooms, and other work environments. While most such floors are permanent installations, there are some applications for elevated floors that require the occasional reconfiguration of the floor. For instance, the trading floors of financial exchange buildings are often formed from elevated floors arranged in a series of multi-level trading areas or pits. Reconfiguration of the trading floor can be required to respond to fluctuations in the trading activity carried out in the individual pits.

Reconfiguring an elevated floor structure has heretofore been a time-consuming and expensive task. Conventional designs for floor panels, and support structures for the panels, have been designed to ensure sturdiness of the floor with minimal consideration given to modularity and ease of reconfiguration. A panel assembly and support structure for an elevated floor that could be easily assembled, disassembled, and reassembled in a new configuration without sacrificing sturdiness of the floor, would provide a decided advantage.

SUMMARY OF THE INVENTION

The problems outlined above are in large measure solved by the panel assembly and support structure for elevated floors in accordance with the present invention. The floor panels and support structure of the present invention are especially designed for ease of assembly of an elevated floor, and ease of reconfiguration of the floor once assembled.

The panel assembly for an elevated floor in accordance with the present invention comprises two separate types of panels that are oriented in an essentially checkerboard configuration relative to each other on the assembled elevated floor. Each of the two types of panel structures are formed from a low density oriented strand core material. The two different panel structures, however, have different types of panel cladding fixedly secured to their peripheral edges. The first of the two cladding types includes a support flange extending outwardly from the floor panel peripheral edge. The second of the two cladding types is designed to seat on the support flange of the first cladding. Fasteners are provided for detachably coupling the supported access panels and supporting base panels to one another. The supporting panels are in turn detachably supported on adjustable panel support legs.

The invention also includes interlocking step panels and step riser beams that facilitate assembly and reconfiguration of multilevel step arrangements in the elevated floor.

DETAILED DESCRIPTION OF THE DRAWINGS

Figure 1:
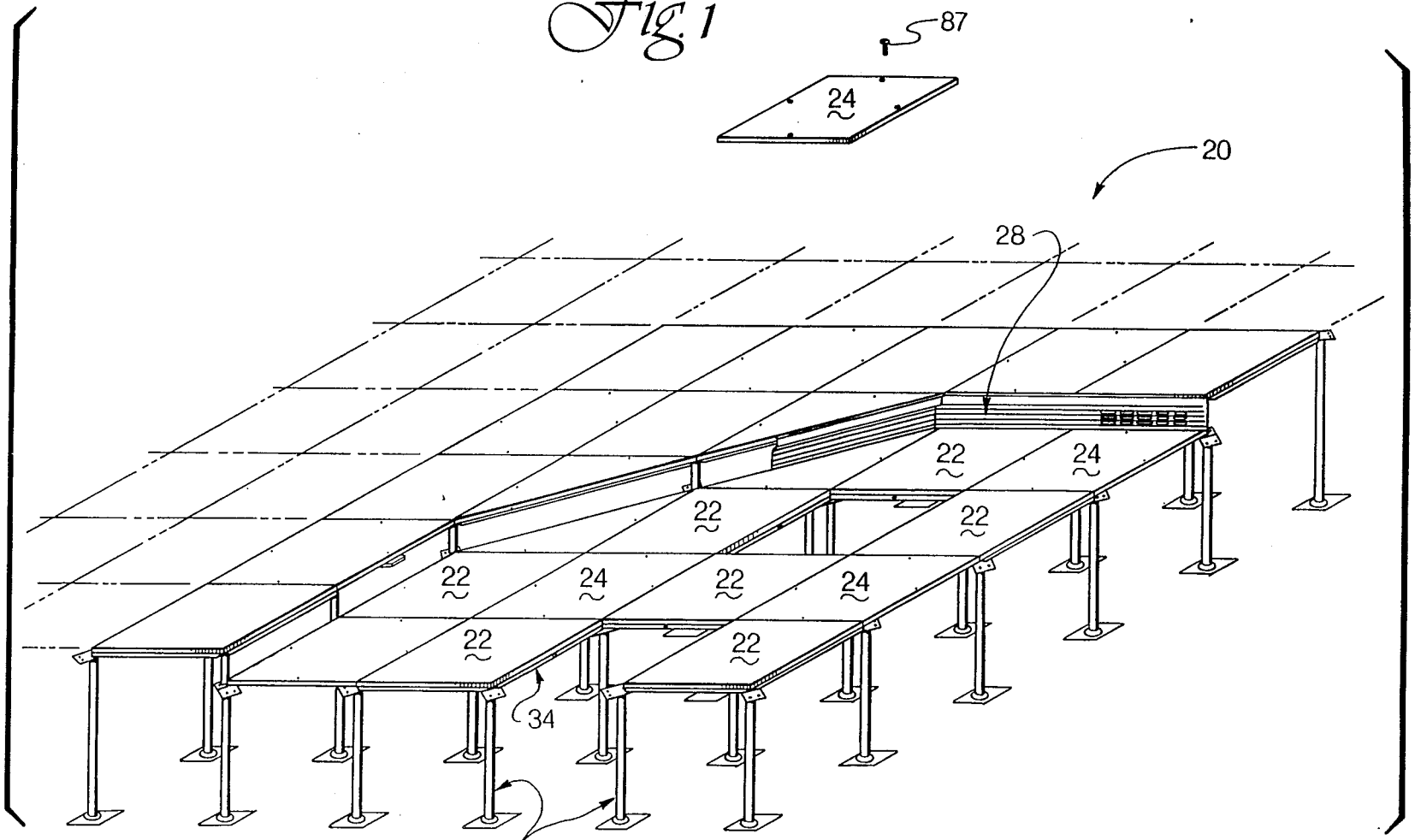
FIG. 1 is a perspective view of an elevated floor incorporating floor panels and panel support members in accordance with the present invention, with an access panel and associated fastener shown suspended over the floor assembly.

Referring to the drawings, an elevated floor 20 in accordance with the present invention broadly includes a plurality of base panel assemblies 22, a plurality of access panel assemblies 24, adjustable support legs 26, and closure panels 28. The base panels 22 and access panels 24 are arranged in an alternating, checkerboard pattern. Both the base panels 22 and access panels 24 preferably comprise a low density oriented strand core member 30. A cover plate 32 of metal, synthetic resin, or other durable material can be attached to the core member 30.

Figure 8:
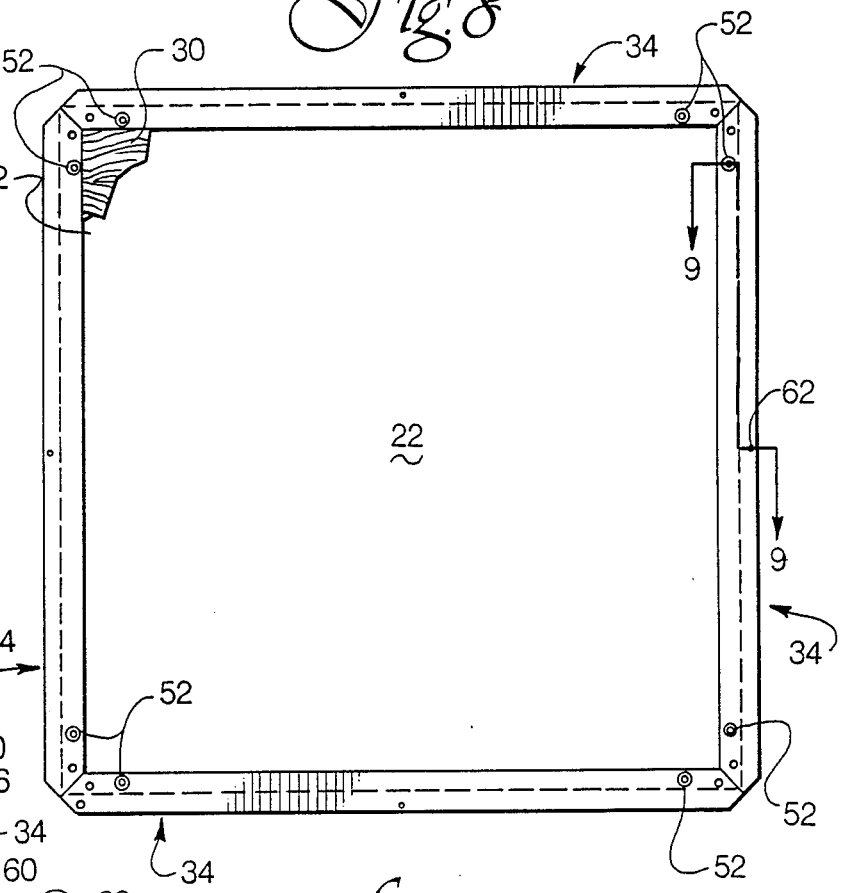
FIG. 8 is a bottom view of a base panel.
Figure 9:
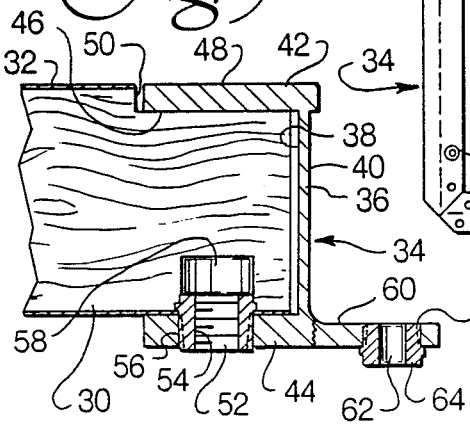
FIG. 9 is an enlarged sectional view taken along the line 9—9 of FIG. 8.

Referring in particular to FIG. 8 and FIG. 9, each of the base panels 22 includes a base panel cladding strip 34 along each of its peripheral edges. The base panel cladding strip 34 includes an upright central web 36 having a panel facing side 38 and an exposed side 40. Upper and lower, generally horizontal flanges, 42, 44 extend laterally away from the panel facing side 38 of upright web 36. The upper flange 42 of base panel cladding strip 34 includes a panel engaging bottom surface 46 and exposed upper surface 48. Referring to FIG. 9, a flange receiving recess 50 can be formed in panel core member 30 such that the upper base panel flange 42 is carried by the core member 30 flush with the upper surface of cover plate 32.

Figures 2, 3:
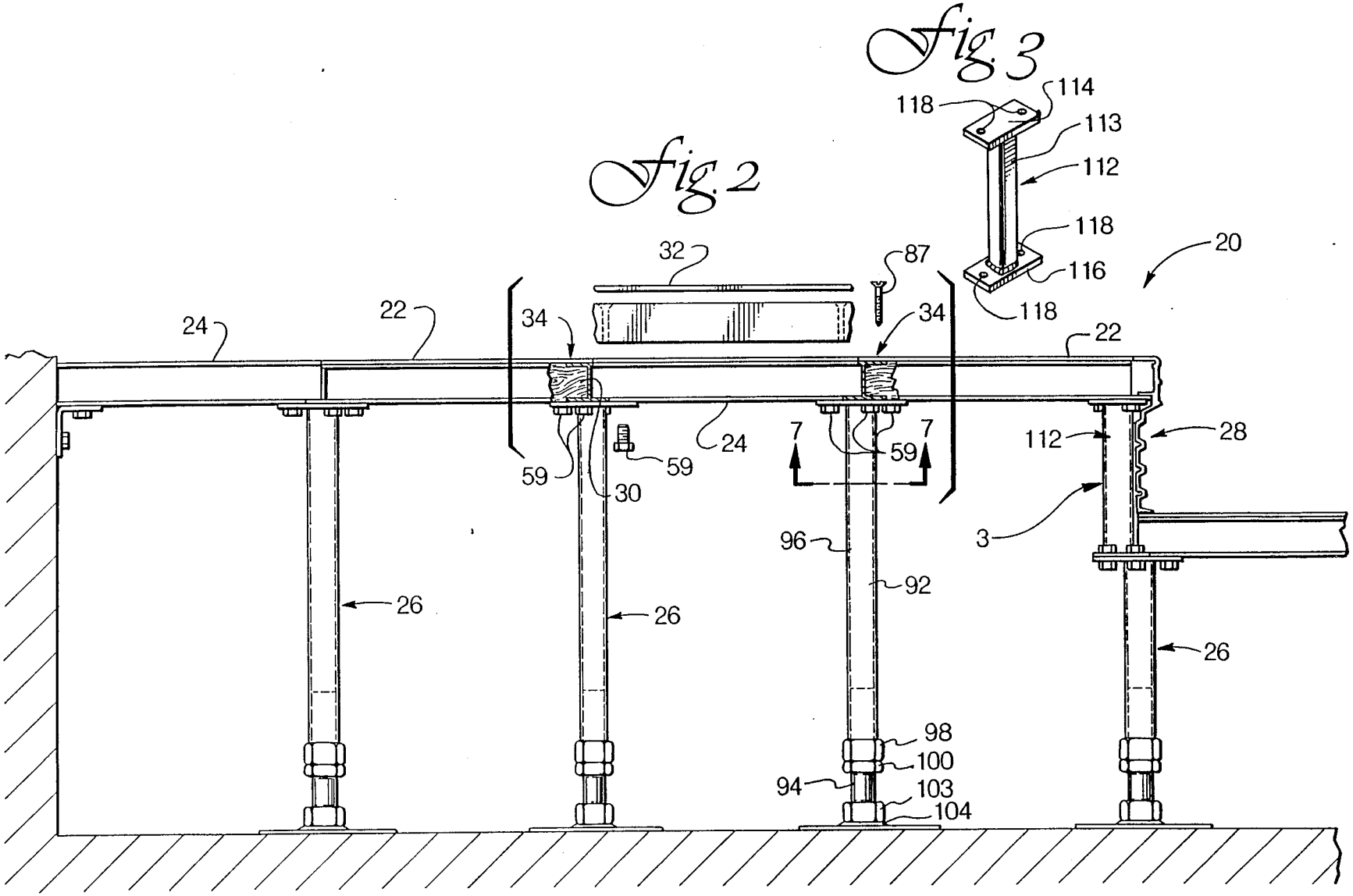
FIG. 2 is a side, elevational view of the assembly shown in FIG. 1, with various parts depicted in an exploded format.
FIG. 3 is a detailed, perspective view of a subfloor leg taken at 3 in FIG. 2.
Figure 7:
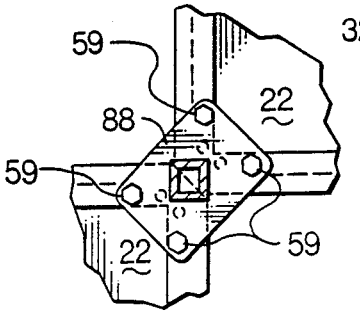
FIG. 7 is a sectional view taken along the line 7—7 of FIG. 2.

The lower flange 44 of base panel cladding strip 34 is received in a tight fit by the lower surface of the base panel core member 30. Fastening bolt apertures 52 are bored through the lower flange 44 of base panel cladding strip 34 proximal to the corners of the base panel 22. Threaded channel inserts 54 are held within the bolt receiving apertures 52 in a force fit by annular wedge inserts 56. The inserts 54, 56 are received within cavity 58 of core 30. Referring to FIG. 2 and FIG. 7, threaded bolts 59 are removably received within threaded inserts 54.

Base panel cladding strip 34 further includes lowermost, generally horizontal, access panel supporting flange 60. The access panel supporting flange 60 includes a fastener receiving aperture 62 at its approximate mid point. A threaded channel insert 64 is retained within the aperture 62 in a force fit by annular wedge insert 66.

Figure 10:
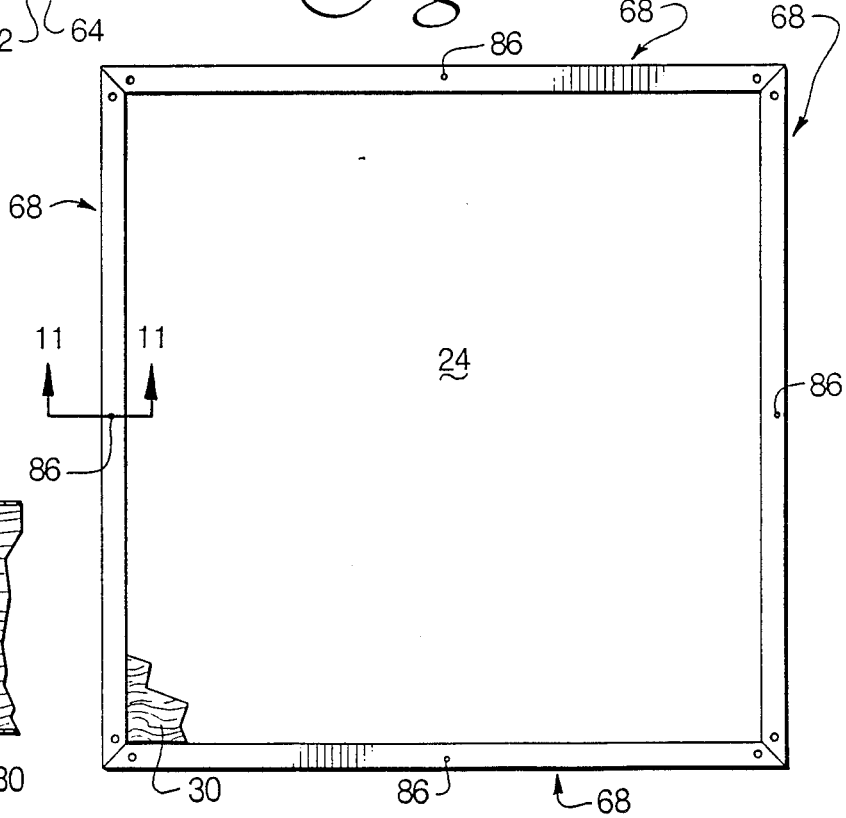
FIG. 10 is a top plan view of an access panel.
Figure 11:
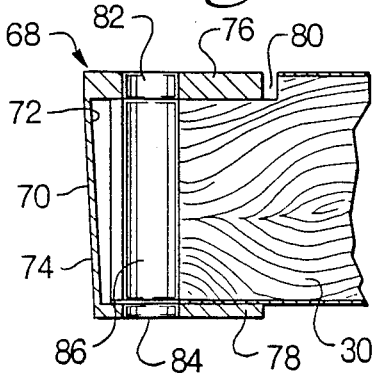
FIG. 11 is an enlarged, sectional view taken along the line 11—11 of FIG. 10.

Each base panel cladding strip 34 is secured to its respective edge of the core member 30 of base panel 22 by an adhesive. Referring to FIG. 8, it will be seen that each base panel cladding strip 34 extends along the entire length of the base panel edge to which it is secured Referring to FIGS. 10 and 11, an access panel 24 will now be described. An access panel cladding strip 68 is secured to each marginal edge of the access panel 24. The access panel cladding strip 68 includes a generally upright web 70 having a panel facing side 72 and an exposed side 74. Upper and lower, generally horizontal flanges 76 and 78 extend outwardly from the web 70 of the access panel cladding strip 68. Referring to FIG. 11, the upper flange 76 of the access panel cladding strip 68 is received within a recess 80 of the access panel core member 30. The upper and lower flanges 76, 78 of the access panel cladding element 68 include aligned fastener receiving apertures 82, 84. Referring to FIG. 11, the apertures 82, 84 are aligned with each other and with bored through channel 86 in the core member 30. Referring to FIG. 1, a threaded bolt 87 is receivable through the channel 86 and apertures 82, 84, for threaded seating in the channel insert 64 retained within the fastener receiving aperture 62 in the base cladding strip 34.

Similar to the base panel cladding strips 34, the access panel cladding strips 68 are secured to their respective edges of the core member 30 of access panel 24 by an adhesive. Referring to FIG. 10, it will be seen that each access panel cladding strip 68 extends along the entire length of the access panel edge to which it is attached.

Figure 4:
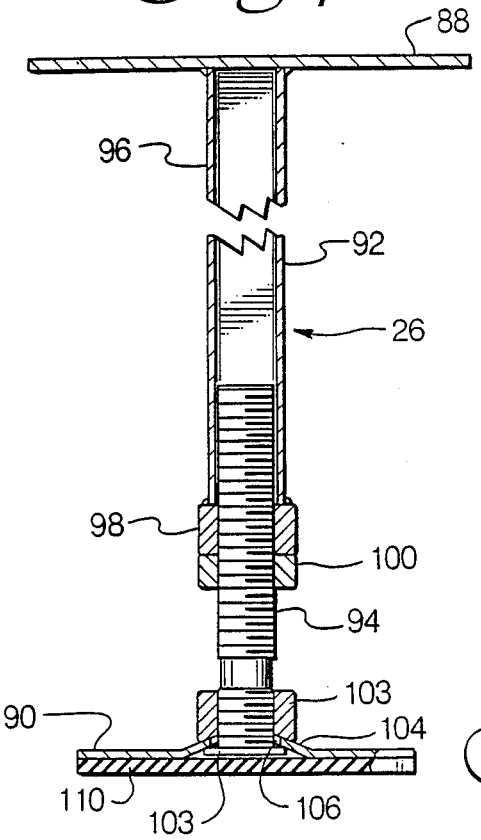
FIG. 4 is a sectional view of an adjustable support leg.
Figure 5:
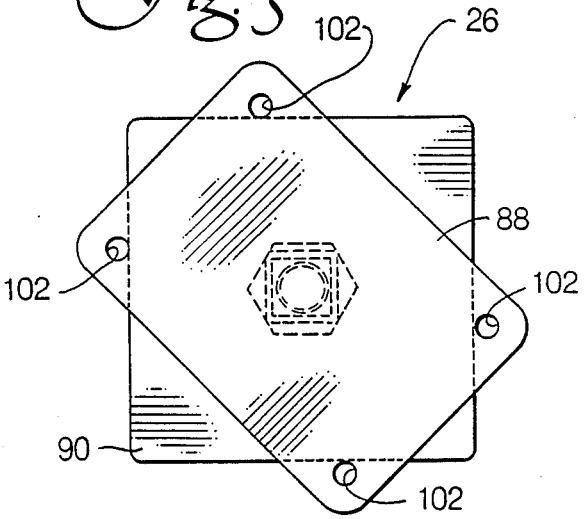
FIG. 5 is a top plan view of an adjustable support leg.

Referring to FIGS. 4 and 5, each support leg 26 includes uppermost, base panel supporting plate 88, lowermost floor engaging plate 90, and threaded telescoping support rod 92.

Telescoping support rod 92 includes a generally cylindrical, threaded lower post 94, and an upper, square in cross section channel 96. The upper channel 96 includes a hex nut 98 welded to its lower end. The hex nut 98 is threadably received on lower post 94, and is retained at its selected height by locking nut 100.

Upper, base panel supporting plate 88 is welded to the uppermost end of the upper channel 96 of telescoping support rod 92. The generally rectangular base panel supporting upper plate 88 includes fastener receiving apertures 102 at each of its four corners.

Threaded lower post 94 threadably carries locking nut 100. Lower post 94 includes a retainer flange 103 at its lower end.

Figure 6:
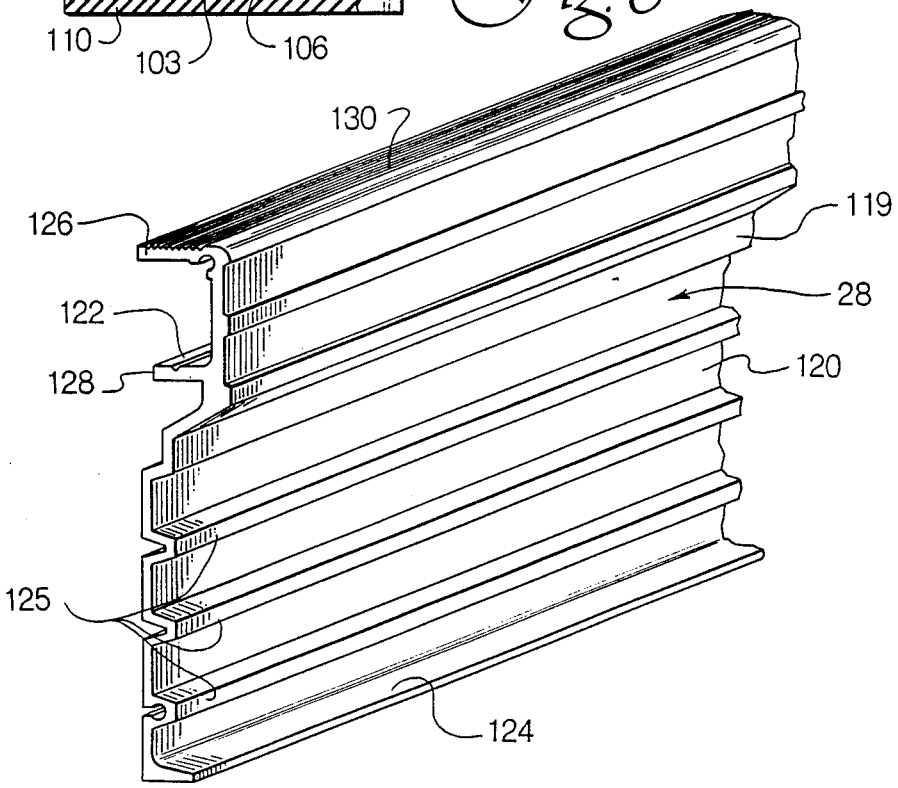
FIG. 6 is a perspective view of a closure panel.

The lower plate 90 of leg 26 is stamped and formed to include a centered, apertured dimple 104. Referring to FIG. 6, it will be seen that the aperture 106 in dimple 104 has a diameter that is larger than the diameter of the lower post 94 of telescoping support rod 92, and the lower post 94 is received through the aperture 106 in a loose fit. Annular flange 103 has a diameter larger than the diameter of the dimple aperture 106. The lower plate 90 includes a ground engaging, elastomeric pad 110.

Referring to FIGS. 2 and 3, subfloor leg 112 includes upright support rod 113 and upper and lower support plates 114, 116. The subleg support plates 114, 116 are generally rectangular in shape and include bolt receiving apertures 118.

Closure panel 28 comprises an extruded, unitary web 119, having an exposed face 120 and an opposed, rear surface 122. Generally horizontal foot flange 124 extends outwardly from exposed face 120. A plurality of generally horizontal folded ribs 125 extend outwardly from exposed face 120 of web 119. A pair of upper and lower, generally horizontal flanges 126, 128 extend rearwardly from the rear surface 122 of web 119. The upper surface of upper flange 128 includes a plurality of ribs and grooves defining a tread surface 130.

Referring to FIGS. 12–26, a multileveled, stepped riser assembly 150 for an elevated floor in accordance with the present invention is depicted. The stepped riser assembly 150 broadly includes step panels 152, riser beams 154, support legs 156, and perimeter beams 158.

The stepped panels 152 include core member 160 formed from wood, a low density oriented strand board, or other suitable material. A top cover plate 162 of metal, synthetic resin, or other durable material, is attached to the core member 160. An extruded edge cladding strip 164 is included along the front and rear edges of each panel 152.

Figure 21:
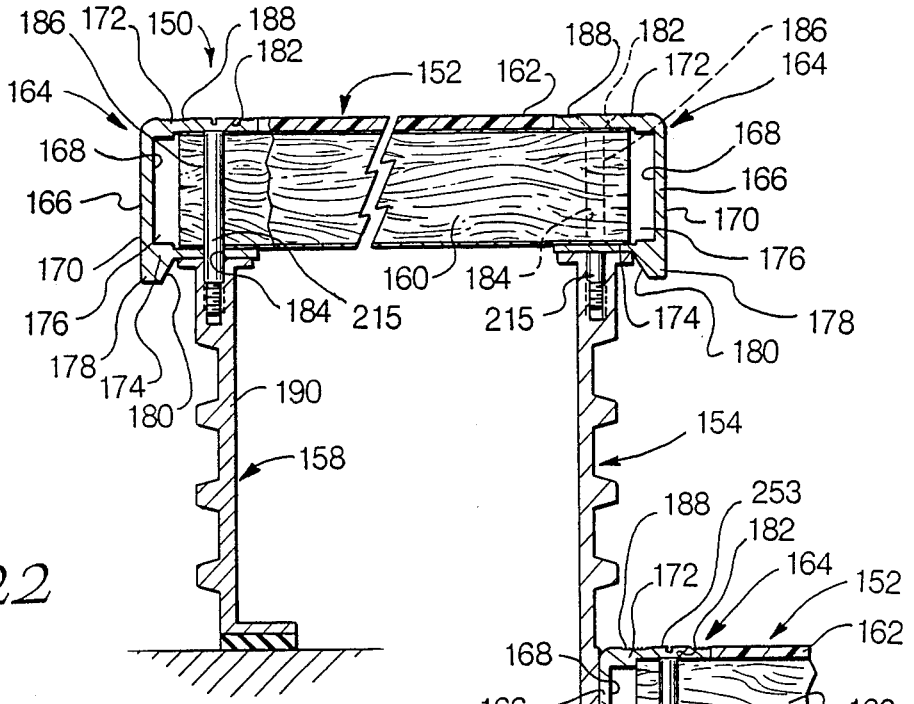
FIG. 21 is a sectional line taken along the line 21—21 of FIG. 12.
Figure 22:
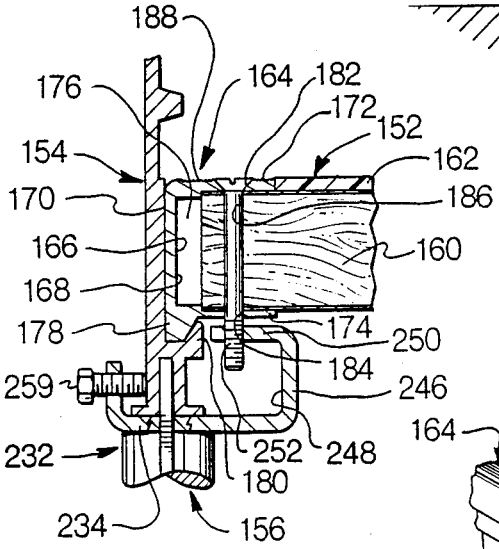
FIG. 22 is an enlarged, fragmentary, sectional view of an alternate support leg bracket.
Figure 22:
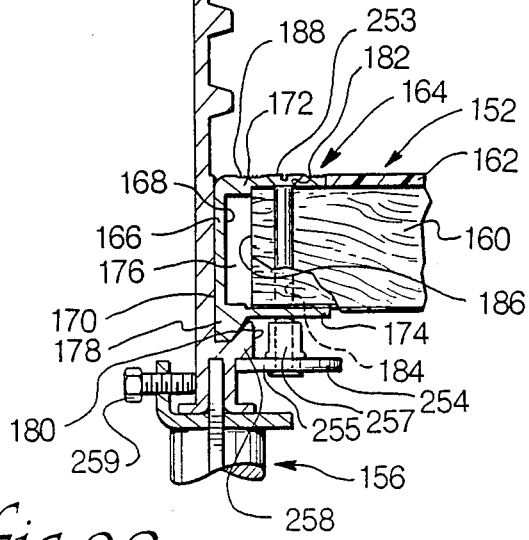

Referring to FIGS. 21 and 22, edge cladding strips 164 each include a generally upright web 166 having an inside, panel engaging face 168 and an exposed face 170. Upper and lower, generally horizontal flanges 172, 174 extend outwardly from the panel face 168 of web 166 to form a core receiving channel 176. A lowermost, elongated cladding strip lip 178 extends downwardly from the web 166. Lip 178 has an inner, chamferred face 180. The upper and lower flanges 172, 174 of edge cladding strip 164 include a plurality of upper and lower, aligned fastener receiving apertures 182, 184. Referring to FIGS. 21 and 22, the apertures 182, 184 are aligned with fastener receiving channels 186 in the core member 160. The upper surface of upper cladding flange 172 includes a plurality of ribs and grooves defining a tread surface 188.

Figure 20:
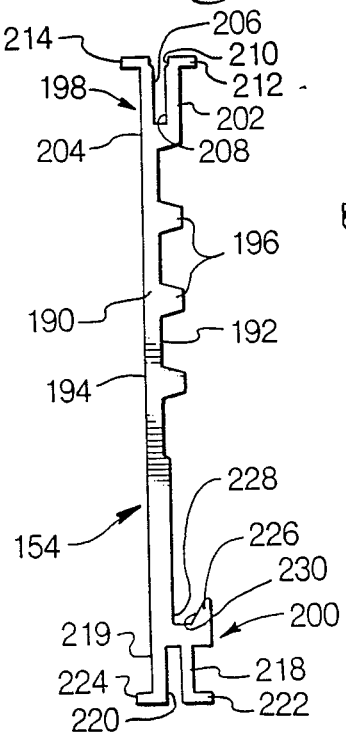
FIG. 20 is a side elevational view of a stepped riser beam.

Referring to FIG. 20, riser beam 154 comprises an extruded, unitary web 190. Web 190 includes an exposed face 192 and an opposed, rear surface 194. A plurality of generally horizontal stengthening ribs 196 extend along the exposed face 192. The riser beam 154 includes step panel engaging head portion 198 and foot portion 200 extending along its upper and lower portions respectively.

Riser beam head portion 198 includes elongated front wall 202 and opposed back wall 204. The head portion front and back walls 202, 204 together define a self-threading fastener receiving channel 206. Referring in particular to FIG. 20, the channel 206 is generally U-shaped in cross section having a first inner channel width 208, and a second, larger, opening area width 210. Generally horizontal, uppermost panel engaging flanges 212, 214 are carried by the front wall and back wall 202, 204, respectively.

Figure 19:
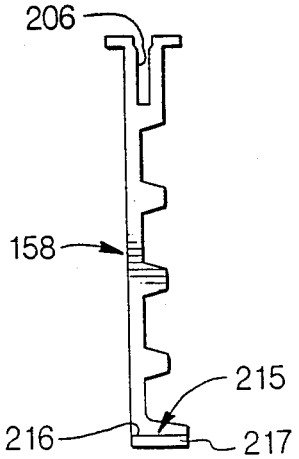
FIG. 19 is a side elevational view of a base riser beam.

Referring to FIG. 19, perimeter beams 158 are similar in construction to riser beams 154. The foot portion 215 of base beam 158, however, comprises a single, horizontal foot flange 216 having an elastomeric pad 217.

Referring to FIG. 21, threaded bolts 215 are received through fastener receiving channels 186 in core member 160, and are threadably received within self-threading channel 206 of the riser beam head portion 198.

Foot portion 200 includes front wall 218 and back wall 219. Foot portion front and back walls 218, 219 together define a support leg bracket receiving channel 220. Lowermost, generally horizontal, support flanges 222, 224 are carried by the front wall 218 and back wall 219 respectively. Upwardly oriented lip 226 extends outwardly from the front wall 218 of foot portion 200. The lip 226 presents a retaining groove 228 along the lower portion of the exposed face 192 of riser beam 154. The lip 226 includes inner chamferred face 230.

Figure 15:
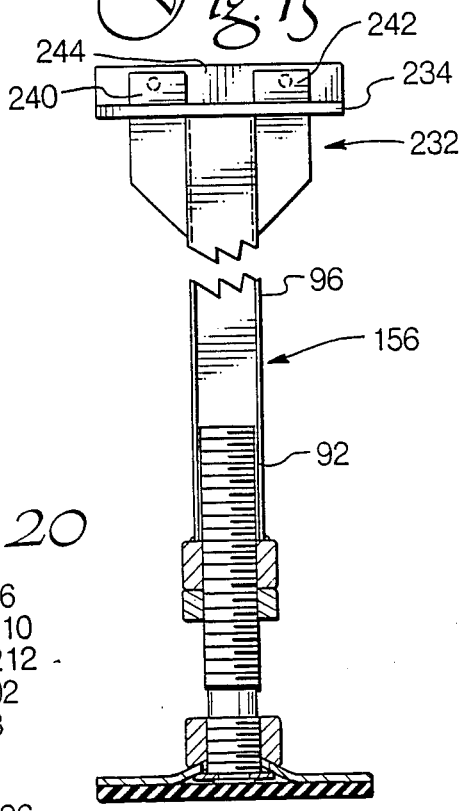
FIG. 15 is a sectional view of an adjustable support leg for the riser assembly.

Referring to FIG. 15, it will be appreciated that support leg 156 is in most respects identical to the support leg 26 described above and depicted in FIG. 4. Accordingly, similar features bear the same numerical annotations in the drawings. The head portion 232 of support leg 156, however, is especially adapted for supporting riser beams 158.

Figure 16:
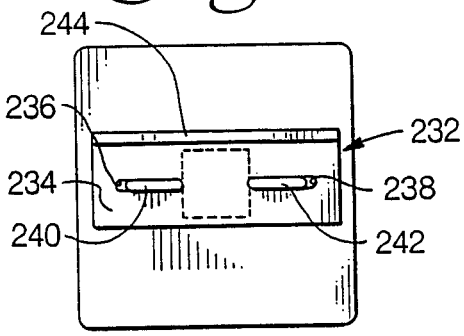
FIG. 16 is a top plan view of the support leg depicted in FIG. 15.

In particular, and referring to FIGS. 15 and 16, the head portion 232 of support leg 156 includes generally horizontal top plate 234 affixed to the upper channel 96 of the support leg telescoping support rod 92. The upper plate 234 includes aligned slots 236, 238. Opposed braces 240, 242 are welded to opposite sides of upper channel 96 and extend through respective slots 236, 238. Backing bracket 244 extends upwardly from the rear margin of the support leg upper plate 234.

Referring to FIG. 22, an alternate form of the support leg head portion 232 includes corner brace 246 extending outwardly and upwardly from the front margin of the head portion upper plate 234. The corner bracket 246 includes generally vertical front wall 248 and generally horizontal top wall 250. Top wall 250 includes fastener receiving aperture 252.

Referring to FIG. 21, a threaded bolt 253 is received through the channel 186 in the lower step panel 152. The bolt 253 is threadably received in fixture 254. Fixture 254 includes generally square clamp member 255 and internally threaded nipple 257. Clamp member 255 abuts against and is retained by the lowermost shoulder 258 of the beam riser lip 180.

Referring again to FIG. 22, the corner brace 246 takes the place of fixture 254 in the alternative embodiment of the support leg head portion 232. In the embodiment of FIG. 22, the bolt 253 is threadably received within aperture 252 of corner brace 246. In both embodiments, a retaining bolt 259 is received through the backing bracket 244.

Figure 17:
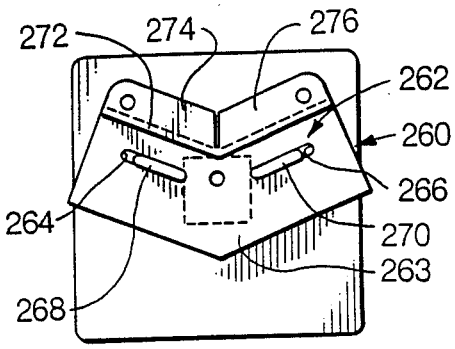
FIG. 17 is a top plan view of a support leg for supporting an inside bend of the riser assembly.
Figure 18:
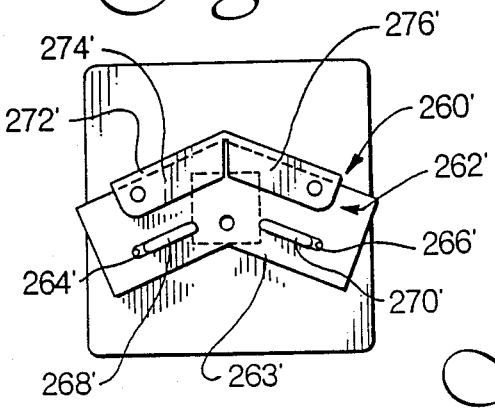
FIG. 18 is a top plan view of a support leg for supporting an outside bend of the riser assembly.

FIGS. 17 and 18 depict alternate designs of support legs 260, 260'. The support legs 260, 260' include head portions 262, 262' especially adapted for supporting the intersection of two angled riser beams 154. In particular, the support legs 260, 260' include angled upper plates 263, 263' having skewed slots 264, 264' and 266, 266'. Braces 268, 268' and 270, 270' are welded to the channel 96 of support leg 26 and extend through their associated upper plate slots. Angled backing brackets 272, 272' extend upwardly from their respective plates 262, 262'. Generally horizontal, panel engaging flanges 274, 276 extend outwardly from the backing bracket 272 of head portion 262, and flanges 274', 276' extend inwardly from the backing bracket 272' of head portion 262'.

Figure 23:
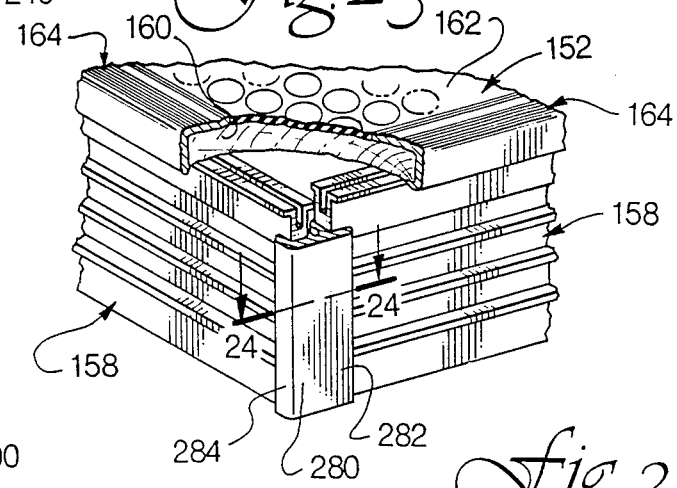
FIG. 23 is a fragmentary, perspective view of a corner joint.
Figure 24:
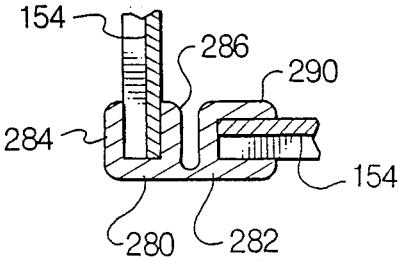
FIG. 24 is a sectional view taken along the line 24—24 of FIG. 23.
Figure 25:
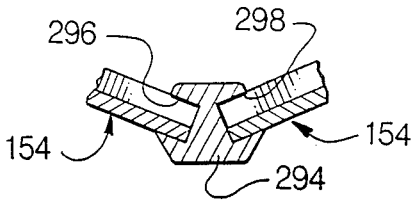
FIG. 25 is a sectional view taken along line 25—25 of FIG. 14.

Referring to FIGS. 23 and 24, corner molding 280 connects adjoining riser beams 254 at a right angle intersection of two riser beams 154. The corner molding 280 includes front wall 282, first and second recess walls 284, 286 forming a recess 288 oriented at a right angle to the front wall 282, and third recess wall 290 defining a recess 292 aligned generally parallel with the front wall 282. Referring to FIG. 25, half bend molding 294 includes skewed recesses 296, 298 for retaining the edges of adjoining riser beams 154 at an angle other than 90°.

Figure 26:
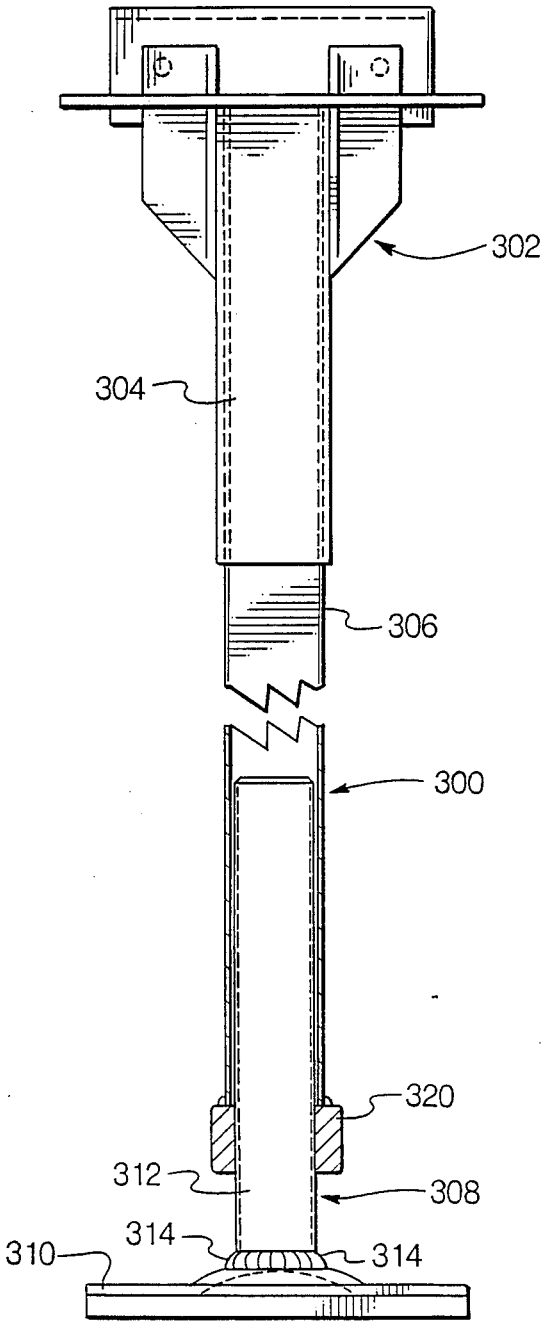
FIG. 26 is a fragmentary, sectional view of an alternate embodiment of a support leg.

Referring to FIG. 26, an alternate support leg 300 is depicted. While support leg 300 is shown with a head portion 302 designed for supporting riser beams 154, it will be understood that the alternate support leg 300 could also include a flat upper plate for supporting base panels 22 and access panels 24. The head portion 302 of support leg 300 is carried by head portion support weldment 304. A support tube 306 is received within the weldment 304 in a force fit. Support tube 306 is in turn received by support leg foot portion 308.

The foot portion 308 of support leg 300 includes base plate 310, and upright post 312. Brackets 314 fixedly attach the post 312 to the base plate 310. Hex nut 320 is threadably received by post 312.

Figure 12:
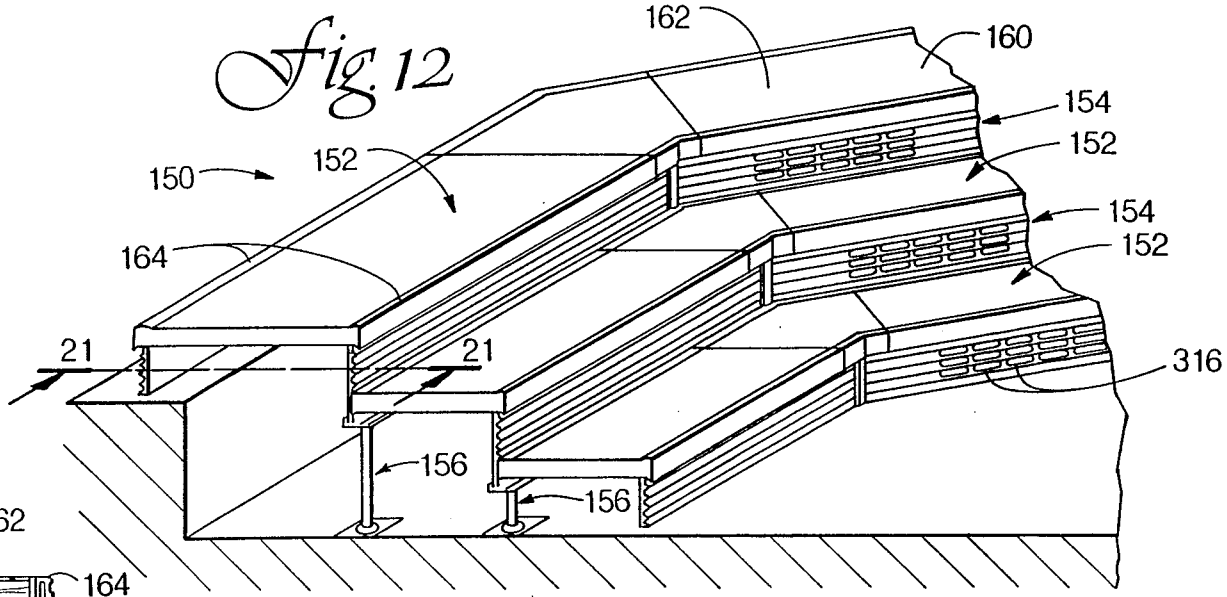
FIG. 12 is a perspective view of a multilevel stepped riser assembly in accordance with the present invention.
Figure 13:
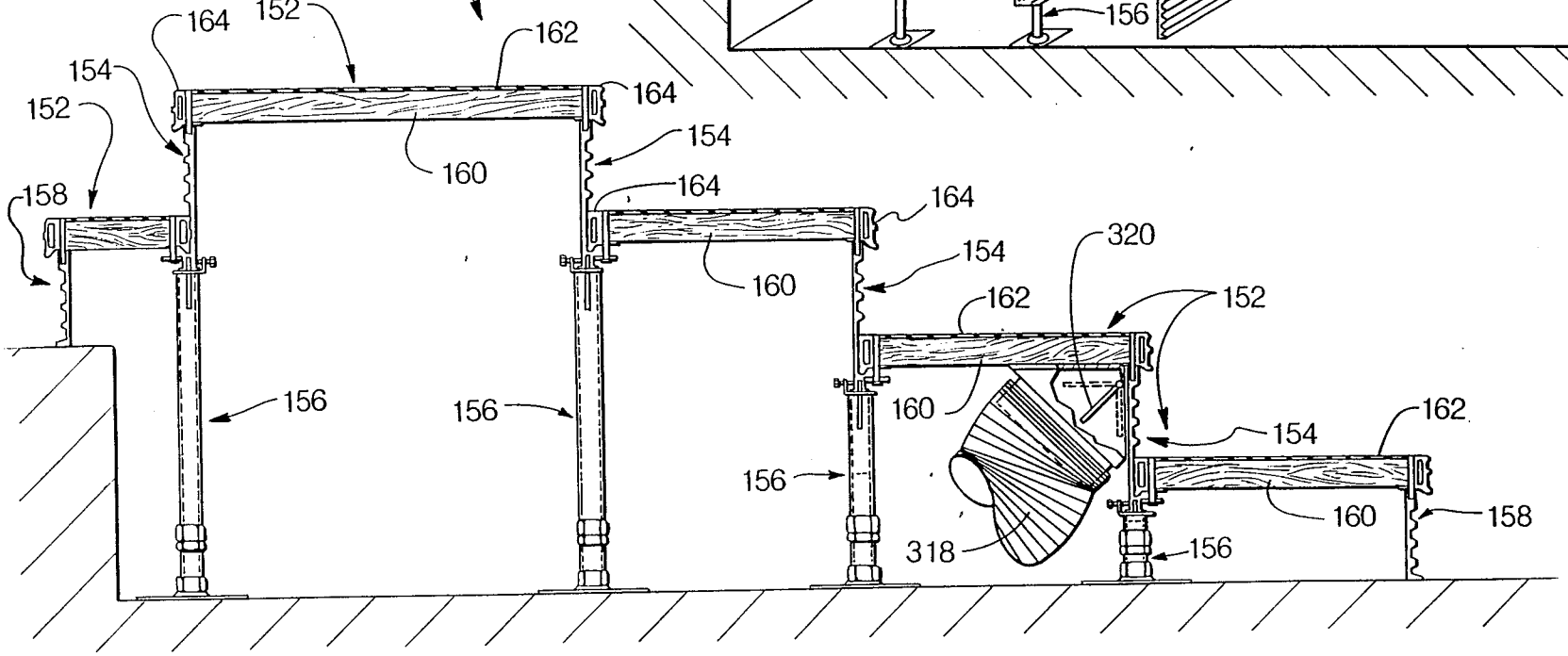
FIG. 13 is a side, elevational view of the stepped riser assembly depicted in FIG. 12.
Figure 14:
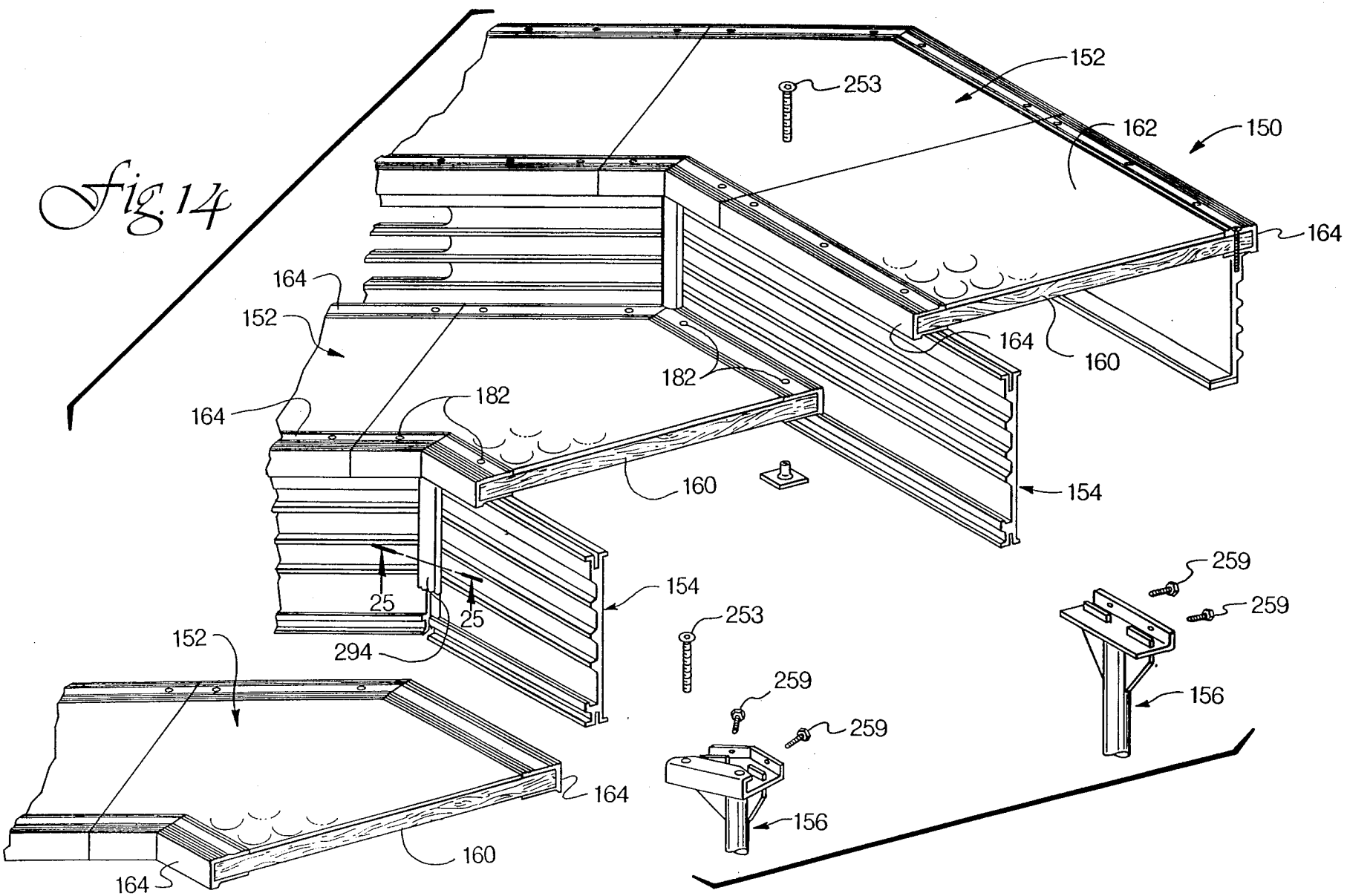
FIG. 14 is an enlarged, fragmentary, partially exploded perspective view of a stepped riser assembly.

Referring to FIG. 12, a plurality of vent ports 316 can be formed in riser beam 154. As shown in FIG. 13, a flexible duct 318 may be attached to the face of a riser beam 154 by duct bracket 320 for directing forced air through the vent ports 316.

Assembly of an elevated floor 20 in accordance with the present invention is accomplished by initially adjusting the height of support legs 26 to the desired level of the floor. Base panel assemblies 22 are then bolted to respective support legs 26. In particular, with reference to FIG. 7, threaded bolts 59 are inserted upwardly through panel supporting plate 88 and are received within threaded inserts 54 and apertures 52.

With base panels 22 in place and supported by supporting legs 26, access panels 24 may be dropped into place. The supporting flanges 60 on the base floor panels 22 receive and support the access panels 24. Threaded bolts 87 are received through respective channels 86 in access panel 24, and are threadably retained within the midpoint apertures 62 in respective base panel supporting flanges 60.

Referring to FIGS. 2 and 3, the single step in floor 20 may be easily provided through the use of subfloor leg 112. The lower plate 116 of subfloor leg 112 is bolted to the upper plate 88 of a respective support leg 26. The upper plate 114 of subfloor leg 112 is bolted into the base panel 22 which it supports. Closure panel 28 provides a decorative cover for the sublegs 112.

The step panels 152, riser beams 154, and support legs 156 facilitate the assembly and reconfiguration of an elevated floor having a multileveled, stepped configuration. Support legs 156 are first adjusted to their approximate desired height. Beam risers 154 are positioned on respective support legs 154 with the bracket receiving channels 220 of the beam riser 192 positioned on the brackets 240 of the support legs 156. Referring to FIGS. 21 and 22, step panels 152 are then secured to the upper portion 232 of support leg 156 with threaded bolts 186 and 259. Adjoining, angled risers 154 are likewise secured to support legs 260, 260' at their respective intersections. Referring to FIGS. 13 and 21, step panels 162 are held in place on the head portions 198 of riser beams 154 by threaded bolts 215.

Referring to FIG. 26, support leg 300 provides the capability of changing the length of the support leg 300 in large increments by removing an appropriate length of tube 306. Additionally, the height of support leg 300 can be adjusted in smaller increments by repositioning the nut 320 on the post 312.

Referring to FIG. 4, the orientation of support leg base plate 90 relative to threaded post 94 is adjustable by loosening nut 103 to allow rotation and pivoting of the plate 90 relative to the post 94. Once the desired orientation is achieved, the position of the plate 90 relative to post 94 can be fixed by tightening nut 103.

We claim:

1. A multileveled, stepped riser assembly comprising:

a plurality of generally horizontal step panels, each panel having a front and rear edge;

a plurality of support legs for supporting said step panels at various levels; and a generally vertical riser beam having an upper and lower margin, an upper interlocking means for detachable coupling of said riser beam upper margin to the front edge of a first, upper step panel, a lower interlocking means for detachable coupling of said riser beam lower margin to a second, lower step panel, and support leg interlocking means for detachable coupling of said riser beam to said support legs.

2. The invention as claimed in claim 1, including front and rear cladding strips carried by said step panel front and rear edges, said upper and lower interlocking means each adapted for detachable coupling with either said front or rear cladding strip.

3. The invention as claimed in claim 2, said front and rear cladding strips having the same shape.

4. The invention as claimed in claim 2, said upper interlocking means comprising a self-threading, upwardly facing channel and a threaded fastener received through said step panel front cladding strip and within said self-threading channel.

5. The invention as claimed in claim 2, said rear cladding strip having a downwardly extending rim, said lower interlocking means comprising an upwardly facing channel for receiving said rim.

6. The invention as claimed in claim 2, said support leg interlocking means comprising a downwardly facing channel, said support leg including an upwardly extending rib receivable within said downwardly facing channel.

7. The invention as claimed in claim 1, each of said support legs comprising a generally vertical support rod including first and second telescoping members and means for adjusting the height of said support rod by shifting the position of said first and second telescoping members relative to each other.

8. The invention as claimed in claim 1 said support legs each including a lowermost ground engaging plate and means for adjustably coupling said ground engaging plate to said vertical support rod whereby the angular tilt of said ground engaging plate is selectively alterable relative to said vertical support rod.

* * * * *